United States Patent [19]

Estes et al.

[11] Patent Number: 4,916,439

[45] Date of Patent: Apr. 10, 1990

[54] REMOTE DISPLAY ARRANGEMENT FOR APPLIANCES

[75] Inventors: Bay E. Estes; Robert J. Crawford; Rolf E. Kowalewski, all of Palatine, Ill.

[73] Assignee: EAC Technologies Corp., Cary, Ill.

[21] Appl. No.: 45,725

[22] Filed: Apr. 30, 1987

Related U.S. Application Data

[63] Continuation-in-part of Ser. No. 498, Jan. 5, 1987, abandoned.

[51] Int. Cl.[4] ..... G08B 21/00; D06F 33/00; G04B 47/00

[52] U.S. Cl. ..... 340/679; 68/12 R; 340/539; 340/683; 368/10

[58] Field of Search ..... 340/679, 539, 309.15, 340/825.69, 825.72, 683, 691, 540, 825.06, 870.16, 825.14, 529, 664, 825.17; 68/12 R; 439/105; 455/66, 67; 368/10–12

[56] References Cited

U.S. PATENT DOCUMENTS

| | | | |
|---|---|---|---|
| 3,032,651 | 5/1962 | Gisiger-Stahli et al. | 455/351 X |
| 3,334,340 | 8/1967 | McConnell | 340/679 X |
| 3,478,344 | 11/1969 | Schwitzgebel et al. | 340/539 X |
| 3,531,791 | 9/1970 | Wells | 340/649 |
| 3,594,784 | 7/1971 | Femminella | 340/286 R |
| 3,811,012 | 5/1974 | Barber | 379/82 |
| 3,842,408 | 10/1974 | Wells | 340/679 X |
| 3,937,004 | 2/1976 | Natori et al. | 368/11 |
| 3,979,739 | 9/1976 | Birchall | 340/529 |
| 3,983,483 | 9/1976 | Pando | 455/89 |
| 4,063,410 | 12/1977 | Welling | 368/10 |
| 4,085,996 | 4/1978 | Koslo | 439/105 |
| 4,184,118 | 1/1980 | Cannalte et al. | 340/825.06 X |
| 4,224,530 | 9/1980 | Simcoe et al. | 68/12 R X |
| 4,225,965 | 9/1980 | Baugh | 455/31 |
| 4,255,669 | 3/1981 | Naugle | 340/664 X |
| B1 4,268,915 | 12/1986 | Parmet et al. | 455/158 |
| 4,279,012 | 7/1981 | Beckedorff et al. | 364/104 |
| 4,463,382 | 7/1984 | Pellegrini et al. | 358/181 |
| 4,480,253 | 10/1984 | Anderson | 340/825.69 |
| 4,510,778 | 4/1985 | Cotton | 68/12 R |
| 4,547,771 | 10/1985 | Rockwood et al. | 340/683 |
| 4,623,876 | 11/1986 | Shima et al. | 340/539 |
| 4,703,306 | 10/1987 | Barritt | 340/825.06 X |

FOREIGN PATENT DOCUMENTS

| | | |
|---|---|---|
| 1540732 | 7/1976 | European Pat. Off. . |
| 0100639 | 7/1983 | European Pat. Off. . |
| 587471 | 4/1977 | Fed. Rep. of Germany . |
| 24-979112 | 7/1949 | Japan . |
| 52-40373 | 3/1977 | Japan . |
| 55-106380 | 8/1980 | Japan . |
| 58-52591 | 9/1981 | Japan . |
| 57-132082 | 8/1982 | Japan . |

OTHER PUBLICATIONS

"Motorola Expands Alarm Control Products" Magazine Article, contact: Motorla, Inc., Comunications Sector 1301 E. Algonquin Road, Schaumburg, IL 60196 or R.S. #152.

European Patent Application EPO.184.606 "Pager Watch System Utilizing Time Slot Communication."

Application No. PCT 86/03.645, "Watch Pager System and Communication Protocol."

*Primary Examiner*—Glen R. Swann, III

*Assistant Examiner*—Thomas J. Mullen, Jr.

*Attorney, Agent, or Firm*—Allegretti & Witcoff, Ltd.

[57] ABSTRACT

Disclosed are two arrangements for remotely indicating the status of a washing machine and/or a dryer. In one arrangement, a current sense circuit is employed along with an optional vibration sense circuit to detect whether or not the washing machine or the dryer are on or off. At a change from on-to-off or from off-to-on, the status of the washing machine or dryer is transmitted over the air to a receiver for status display to the operator. In the second arrangement, detection of the status is internal to the washing machine and the dryer and the status includes additional information such as the type of cycle and the amount of time left before the cycle finishes. To avoid constant transmission of such information, the receiver includes a timer which is synchronized to the washing machine/dryer timing circuits.

35 Claims, 7 Drawing Sheets

REMOTE DISPLAY ARRANGEMENT FOR APPLIANCES

CROSS REFERENCE TO RELATED APPLICATION

The instant application is a continuation-in-part of the instant assignee's U.S. application Ser. No. 000,498, filed Jan. 5, 1987, now abandoned entitled "Remote Display Arrangement for Appliances", invented by Bay Estes et al.

FIELD OF THE INVENTION

The present invention relates generally to display arrangements, and, more particularly, to a remote display arrangement for laundry appliances.

DESCRIPTION OF THE PRIOR ART

Present day laundry appliances are not provided with remotely located indicators which provide status information of the appliance. For example, for a washing machine it would be desirable to be notified whether or not the load is finished. In some situations it would be desirable to know if a particular washing cycle has been completed or how much time is remaining in the cycle. In the home, while the appliance operator is in an upstairs room and the washing machine and dryer are in a downstairs utility area, it is not uncommon for the appliance operator to scurry back and forth between rooms to catch the load before a cycle finishes. Therefore, although much of this status information is readily apparent at the controls of most washing machines, such information is not available to the remotely located appliance operator.

Attempts to overcome this problem have been overly complex and expensive, or cumbersome to implement. One such solution suggests remotely wiring the appliance display panel to other areas of the dwelling. Another solution suggests a technique for remotely wiring the display and control circuits of the appliance to a central location where a controller may be employed to stop and start the cycle. Unfortunately, the former of these solutions is not practical in most homes as the labor expense to wire the home would be excessive. The latter solution is not as expensive to wire, considering there is only one central area, but it provides only one area of display. Moreover, the cost of such a controller is relatively expensive as the control functions are not essential to the display function.

Accordingly, a remote display arrangement for appliances is needed which overcomes these deficiencies.

SUMMARY OF THE INVENTION

It is an object of the present invention to provide a remote display arrangement for appliances which overcomes the above mentioned problems.

It is an additional object of the present invention to provide a remote display arrangement for appliances which may be readily adapted to existing appliances.

It is yet another object of the present invention to provide a remote display arrangement for appliances which is substantially synchronized to the appliance timing circuits.

It is yet another object of the present invention to provide a portable remote display arrangement for appliances which minimizes battery drain.

The present invention may briefly be described in terms of a preferred embodiment involving an arrangement for remotely indicating the status of an appliance, such as a washing machine or a dryer. The arrangement comprises a detector, electrically connected to the appliance for detecting the status thereof and generating representative status signals; a signal conditioner electrically connected to the detector for receiving the status signals and encoding the signals for subsequent transmission therefrom; transmission means electrically connected to the signal conditioner for transmitting the encoded signals over the air; and a receiver, located remotely from the transmitter, for receiving the transmitted encoded signals. The receiver is coupled to an indicator for displaying the status of the appliance in combination with a wristwatch.

The indicator includes timing means for synchronization to the timing of the appliance cycles. Additionally included in the arrangement is a broadcast control technique wherein the transmitter broadcasts status information to the receiver/indicator once per minute and the indicator activates the receiving circuitry during the same interval, thereby saving significant power.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawing, in which like reference numerals identify like elements, and wherein:

DETAILED DESCRIPTION OF THE PREFERRED EMBODIMENT

Figure 1A:
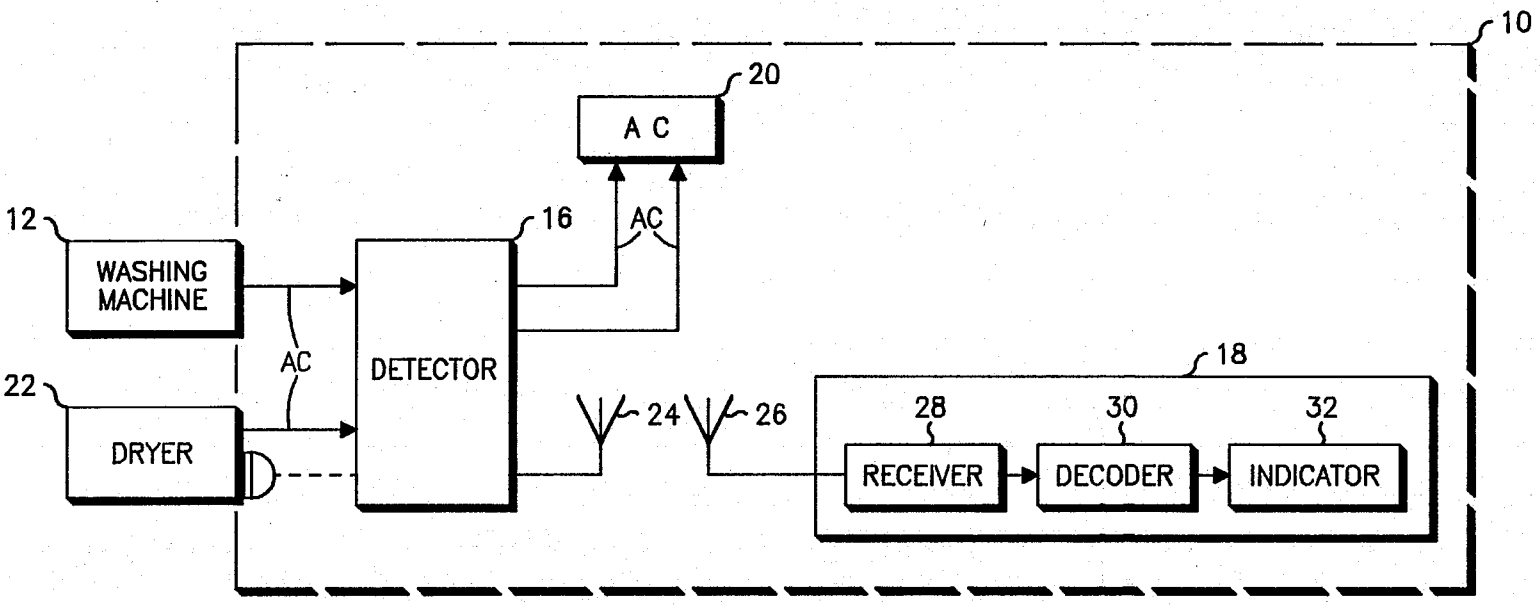
FIG. 1*a* is a block diagram of a remote display arrangement in accordance with the present invention.
Figure 1B:
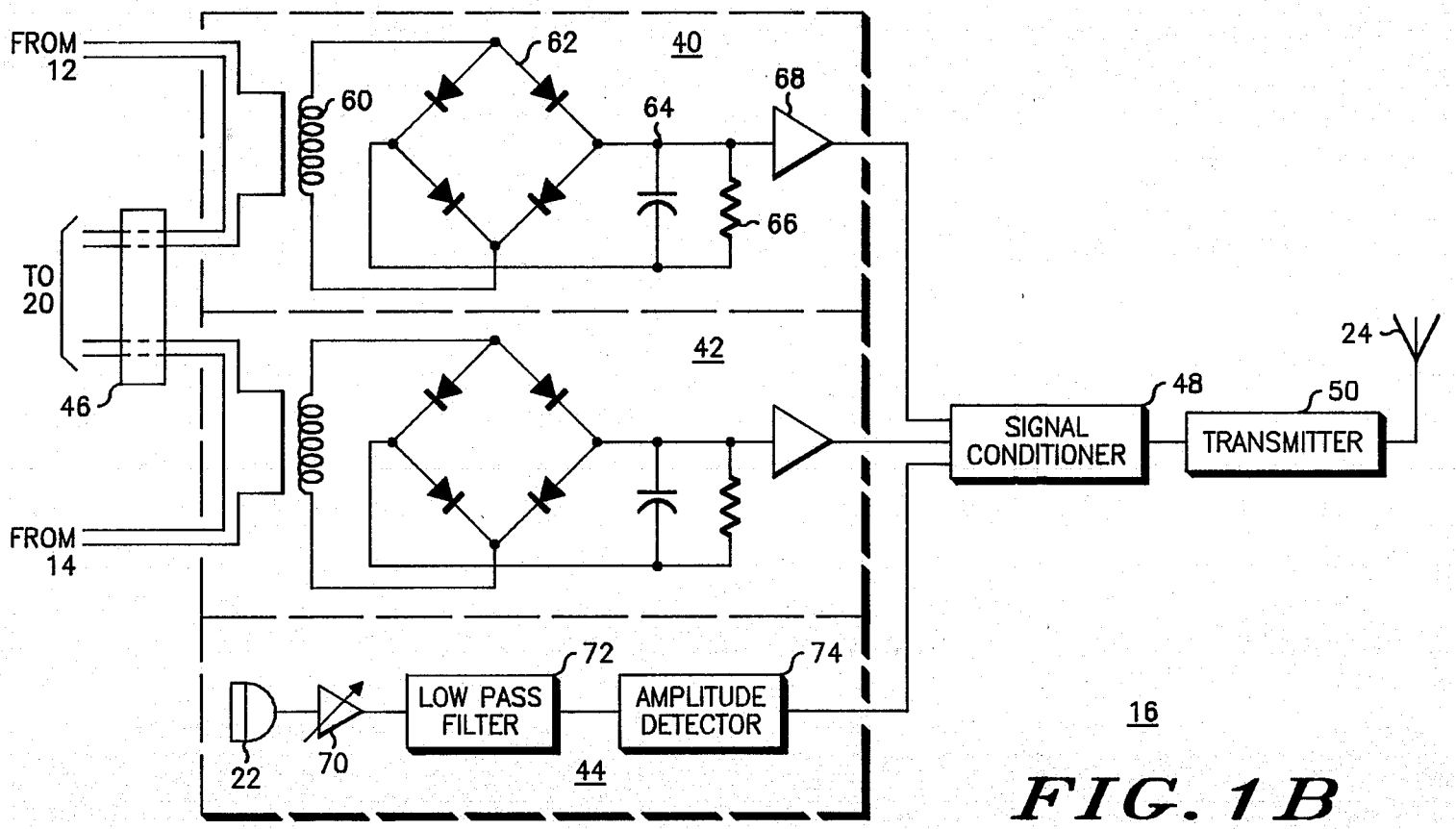
FIG. 1*b* is a circuit diagram of block 16 of FIG. 1*a*.

In FIGS. 1A and 1B, a remote display arrangement 10 for two appliances, a washing machine 12 and a dryer 14, is shown. The arrangement includes a detector 16, a receiver unit 18 and an AC power source 20. The detector 16 is adapted to receive a standard power plug from both the washing machine 12 and the dryer 14. Connection of the power plugs into the AC source 20 is made through the detector 16 to provide the washing machine and the dryer with uninterrupted power. As will be described in detail in FIG. 1*b*, the detector 16 includes a current sense circuit for detecting whether or not power is being provided to the appliances, as well as an optional vibration detector which may be handily employed with a 220 volt electric dryer having a relatively large three prong AC power plug.

By detecting whether or not power is being provided to the appliance, the detector 16 can determine if the appliance is on or off, i.e., if the load has been completed. To remotely communicate this information to the appliance operator, the detector 16 includes a transmitter (depicted as 50 in FIG. 1*b*) for modulating and transmitting the information and an antenna 24. The receiving unit 18 accepts this information through an antenna 26, demodulates the information through a receiver 28, and decodes this information through a decoder 30 for indication to the operator at an indicator 32. The decoder 30 is used to selectively control the indicator 32 from the decoded signals. The indicator 32 is preferably an LCD display, but may include audible indication or other types of visual indication.

Referring now to FIG. 1*b*, the detector 16 of FIG. 1*a* is shown in expanded form. The detector 16 includes two substantially identical current sensing circuits 40 and 42 which interface, via an AC receptacle/plug 46, the AC lines from the washing machine 12 and the dryer 14 to the AC power source 20.

The current sensing circuit 40 comprises a current transformer 60 having a primary in series with an AC line from the washing machine 12. The secondary of the current transformer 60 is connected to a bridge rectifier 62 in parallel with a shunt resistor-capacitor circuit, depicted as 64 and 66 respectively, to develop a positive voltage for a high gain amplifier 68 whose output is connected to a first input of a signal conditioner 48.

As the current sensing circuit 42 is similarly connected to a second input of the signal conditioner 48, no further discussion of circuit 42 is warranted.

A vibration sensing circuit 44 is connected at a third input of the signal conditioner 48. As discussed above, the vibration sensing circuit is preferred for a 220 volt electric dryer. The vibration sensing circuit 44 includes an electromechanical transducer 22 such as a piezoelectric receiver, a variable gain amplifier 70, a low pass filter (LPF) 72 and an amplitude detector circuit 74 respectively connected in a cascaded fashion. The electromechanical transducer 22 is preferably directly coupled to the dryer 14 for optimal reception. The variable gain amplifier 70 is provided to optimize the received signals resulting from the vibrations emitted by the dryer. The amplitude detector circuit 74 generates an acceptable output signal whenever the output of the LPF 72 indicates presense of a detected vibration. Accordingly, the LPF 72 and the variable amplifier 70 serve to differentiate the vibrations from interferring signals.

The signal conditioner 48 is preferably a microcomputer having peripheral input ports that receive the signals from the sensing circuits 40, 42 and 44; for example, Motorola's MC6805 is an adequate microcomputer. The signal conditioner 48 is used to encode the information from the sensing circuits 40, 42 and 44 for serial transmission by a transmitter 50. A Manchester coding format is appropriate for such transmission and will minimally include two information slots including an on/off indication for the washing machine 12 and an on/off indication for the dryer 14.

Transmissions between the detector 16 and the receiver block 18 are preferably communicated about the occurence of the washing machine or the dryer changing its operating status, i.e., communication may be made when the dryer turns "on" and turns "off". It is preferred that the signal conditioner additionally includes a delay function for the vibration sensing circuit 44. The delay function inhibits transmission of the "on" indication for the electric dryer for a predetermined initial period, approximately 30 seconds. Such delay prevents false "on" transmissions caused by brief noise interference. Transmissions may therefore be communicated at the instant of a change of operating status or after a delay of such status change.

For many washing machine appliances and for some dryer appliances, the signal conditioner 48 (FIG. 1*b*) may include a delay function to compensate for operating pause periods or periods during which the appliance is draining low levels of current, such as during a water fill period in the washing machine appliance. Preferably, the delay function is adjustable by the operator so as to accomodate different appliance models and/or cycle conditions.

Accordingly, the arrangement illustrated in FIGS. 1*a* and 1*b* is advantageous in that it may be employed for any brand or type of washing machine and/or dryer, it may communicate the operating status thereof to a receiving unit which may easily be moved from one location to another, and it requires communication to the receiving unit only after the operating condition of the washing machine or dryer changes. Additionally, the arrangement may be inexpensively manufactured and implemented with minimal effort, without technical expertise.

Figure 2A:
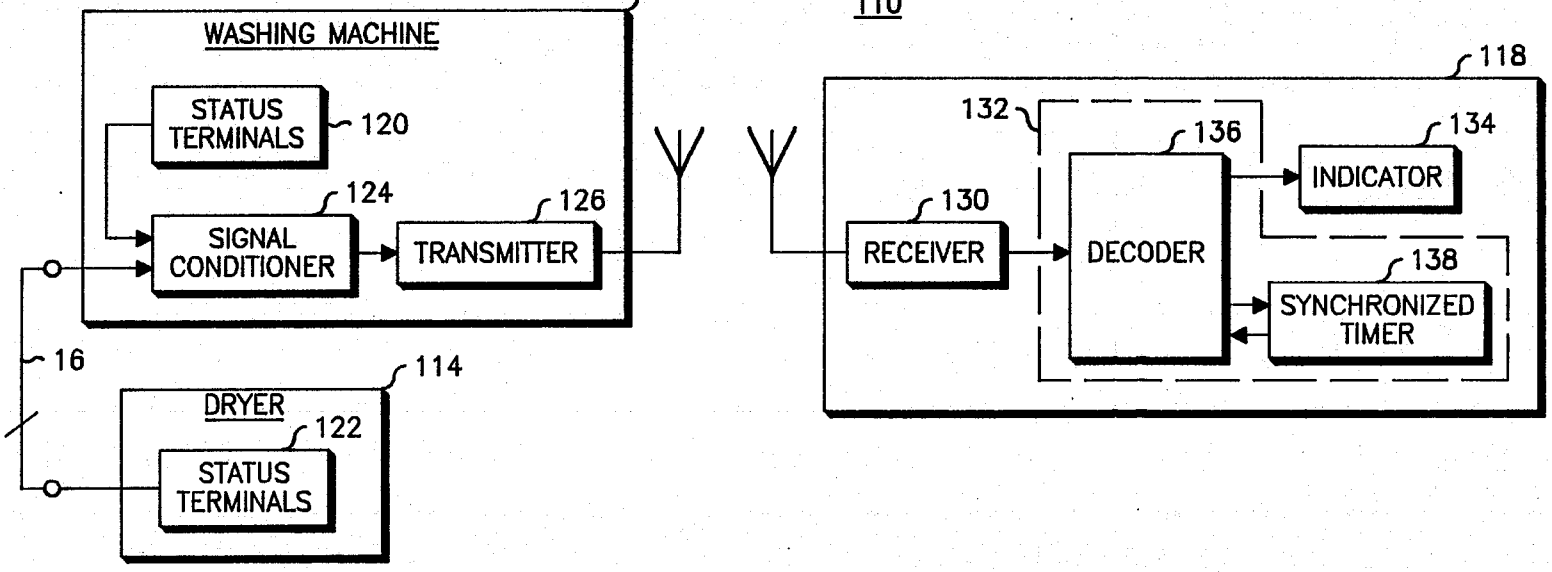
FIG. 2*a* is a block diagram of an alternate remote display arrangement, according to the present invention.

In FIG. 2*a*, an alternative arrangement 110 for remotely indicating the status of a washing machine 112 and/or a dryer 114 is shown. The arrangement 110 includes interconnection apparatus 116 between the washing machine and the dryer, a receiving unit 118 and communication means for communicating from the washing machine and dryer to the receiving unit 118. Both the washing machine 112 and the dryer 114 provide conventional status terminals 120 and 122, respectively, for indicating status conditions, such as whether the washing machine/dryer is on or off, what cycle the washing machine/dryer is presently in and how much time is left before the cycle or load is finished. .The status conditions of the dryer 114 are communicated to a signal conditioner 124 within the washing machine 112 through the interconnection apparatus 116, preferably a wired connection. The status conditions of the washing machine 112 are internally connected to the signal conditioner 124 within the washing machine such that the status of both the washing machine and the dryer may be continually reviewed by the signal conditioner. For substantially the same reasons as in the arrangement of FIGS. 1*a* and 1*b*, the signal conditioner 124 is preferably a microcomputer having peripheral input ports.

The status conditions are communicated to the receiving unit 118 under control by the signal conditioner 124 by employing a transmitter 126 to transmit the information over the air, at selected times or at periodic intervals, to a receiver 130 within the receiving unit. From the receiver 130, the status information is communicated to a display controller 132 for appropriate indication of the information at an indicator 134, such as an LCD display.

The display controller 132 is preferably a single microcomputer chip, but a real time clock may be incorporated therewith, such as Motorola's MC146818. In either case, the display controller 132 serves two functions. The first function is to decode the information received by the receiver 130 for time sychronization and for indication. This may be accomplished by a decoder 136 which identifies the information and selectively updates the sychronized time and the indicator 134.

The second function is to maintain the synchronized time. This is preferably executed by the microcomputer using a conventional software timing program. As discussed above, the time is initially programmed and subsequently updated by the decoder 136.

The time is referred to as "synchronized" because it is originally programmed to indicate an estimation of the remaining time before the washing machine or dryer has finished its cycle/load, and updated at each intelligible status change thereafter. For example, an operator may set the washing machine 112 for an 8 minute wash cycle, in which case the decoder 136 would program the synchronized timer 138 to: 8 minutes+a time estimate of the rinse time+a time estimate of the spin time. Since both the wash and rinse cycles wait for water to fill the washing machine cavity before a timed period of agitation begins, and the water fill time is a function of the pressure at the water valves, the water wait time cannot be precalculated, only estimated. Therefore, each "water fill" occurence is an intelligible status change for updating the timer 138 and outputting such updated information to the indicator 134.

Another intelligible status change would be an operator interruption, as this would cause a delay in the completion time of the cycle or load. When the appliance is manually interrupted, such information can be communicated and displayed at the indicator 134. Once operation of the appliance is resumed, the time remaining for the load/cycle would be communicated to the receiving unit for prompt update of the timer 138 and the indicator 134.

Additionally, a learning device may be included with the receiving unit 118 or the washing machine 112 to allow "water fill" times to be estimated according to previous fill times. This will improve the estimation of the "water fill" time given a nominal water pressure. For example, if the two previous water fill times were recorded, the next fill tim could be estimated as an average of the two previously recorded.

Accordingly, communication of the status information to the receiving unit occurs only at such intelligible status changes, when the operating status ("on"/"off" status changes) and, if the type of cycle is to be enunciated, when the cycle of the washing machine or dryer changes.

Figure 2B:
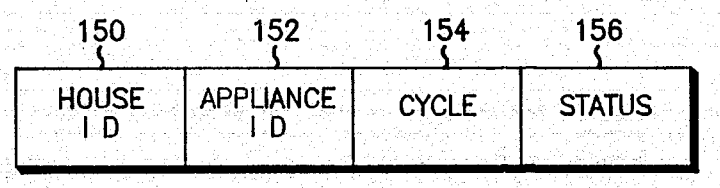
FIG. 2*b* is an illustration of an information packet which may be communicated in the arrangement of FIG. 2*a*.

In FIG. 2*b*, a preferred information packet is depicted for communication from the transmitter 126 within the washing machine 112 to the receiving unit 118. The packet includes four information slots. The first slot 150 identifies the house transmitting the information and may be a user selectable code. This information is used to prevent crossover interference from neighboring dwelling having similar transmissions.

The second slot 152 identifies the appliance which is executing the transmission. This information is used to identify to which appliance, the washing machine or the dryer, the remaining two slots pertain. This information also allows multiple appliances to communicate with the receiving unit.

The third slot 154 is used to identify the cycle of the appliance. Such information is sometimes desirable to the operator as the operator may want to halt a load before a particular cycle begins.

The last information slot 156 is used to communicate miscellaneous information to the receving unit 118, such as the estimated programming time of the load, and subsequent update times.

For either the arrangement of FIG. 1*a* or FIG. 2*a*, it is preferred that communication to the receiving unit be wireless serial transmission (over the air) on a channel at a frequency band between 30 MHz and 500 MHz. A conventional garage door opener type transmitter may be used as the transmitting device, while a compatible type receiver may be used as the receiving device.

Figure 3:
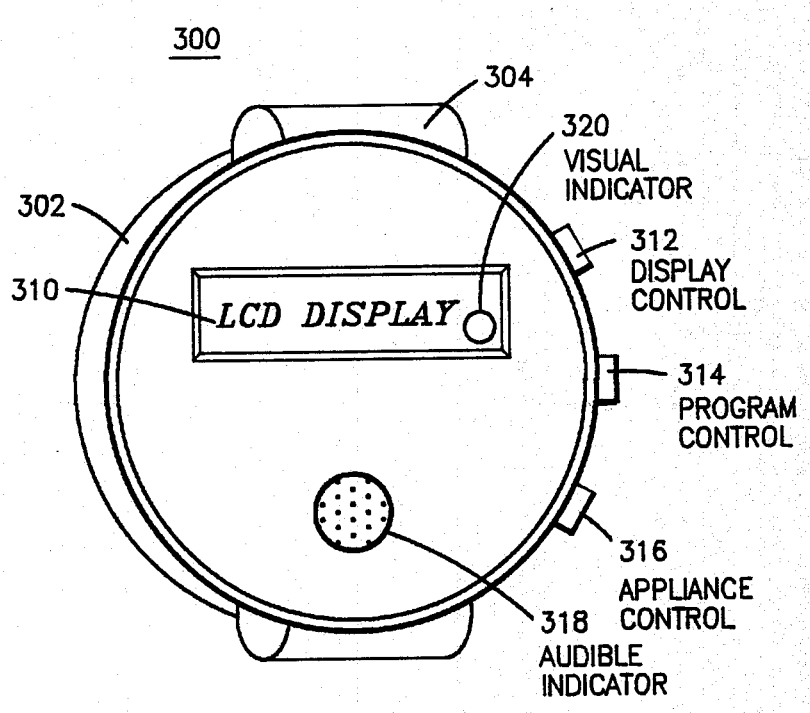
FIG. 3 is an illustration of a combination wristwatch appliance status indicator which may be used to remotely display the status of an appliance in accordance with the present invention.

FIG. 3 illustrates a view of an alternate receiving unit 300 which comprises a combination wristwatch/appliance status indicator which is designed to conveniently indicate to its wearer the time of day as well as the status of one or more household appliances. The receiving unit 300 includes a housing 302 for containing the circuitry to be described below, a wrist band 304 for attaching the unit to one's wrist, and an LCD display 310 for displaying the time of day, month and year as conventionally implemented in digital watches, but additionally for displaying various types of appliance status signals, which may include the cycle (running) time remaining the appliance, the cycle type, etc., as previously discussed. Additionally, control buttons 314, 316 and 318 are included adjacent the housing 302 for controlling the type of display, for programming the various functions of the unit, and for synchronizing the unit 300 to the appliance, respectively.

More particularly, the display control button 312 is used for changing between display modes which may include the conventional time of day and date displays, but also status display types such as the time remaining in the cycle, whether the appliance is off or on and which appliance is being referenced.

The program control button 316 is used for setting references for the display modes discussed above. This control includes the conventional time of day and date programming as well as programming required to set an alert tone, subsequently described, in accordance with the cycle time remaining.

The appliance control button 316 is a utility button which may used to synchronize the "receive time" for the receiving unit. The "receive time" is a time period during which the receiving unit 300 activates its RF receiver circuitry to receive transmissions from the appliance. Preferably, this activation occurs once per minute for approximately 30 msec., thereby defining a 30 msec. time "slot" in every minute as the receive time. This slotted receive time is advantageous in order to minimize battery drain within the receiving unit. By only activating the receive circuitry within the receive unit for only 30 msec/minute, a substantial power savings is effected.

Unfortunately, time reference crystals used for such timing are known to drift. Since this drift may eventually cause the receiving unit to shift the time slot such that the receiving circuitry is activated after or before the transmission from the appliance, the present invention provides a synchronization pattern with each transmission from the appliance. The following synchronization pattern may be used.

Sync Pattern: 011000111101010

The pattern begins with a one 0, followed by two 1's, then 3 0's, then 4 1's and finally a sync end pattern defined as "01010". When the receiving unit activates its receiving circuitry at the beginning of its time slot it begins looking for this pattern. Once recognized, the receiving unit re-aligns its time reference with respect to the 30 msec. time slot to reestablish the proper receive time once each minute, thereby alleviating the drift problem of the crystal.

Setting the receive time to 30 msec. may be excessive, since less than 5 msec. are required for data transmission time. Nonetheless, by providing this excessive time, the receiving unit is allowed to turn on its receiving circuitry well in advance of the expected transmission, thereby allowing substantial leeway before the crystal drifts out of transmission time range. Although the above time slot technique alleviates the drift problem, when the receiving unit is out of RF reception range from the appliance, the receiving unit may still drift beyond the leeway provided by the above excessive receiving time period. It is for this reason that the control button 316 is provided to resynchronize the receiving unit to the appliance transmitter. Once the receiving unit detects that it is no longer receiving data from the appliance during its designated time slot, the user may be alerted by the receiving unit 300 audibly and/or visually. When the user is so notified and the receiving unit is once again within range of the appliance transmitter, the control button 316 is pressed to instruct the receiving unit to calculate the appropriate time period during which the receiver circuitry should be activated to receive the transmitted signals. After the calculation is performed, the normal receiver "on" time is increased by a factor of ten in order to accomodate accumulated error in the drift time between the clock in the transmitter and the clock in the receiver. After the receiver circuitry has been activated for the extended period of time, if sychronization is not reestablished, the operator is so alerted and a reset must be performed on the transmitting appliance.

A reset on the appliance may entail depressing a master reset button or, more simply, unplugging the AC power line to the appliance. In conjunction with the appliance being reset, the appliance control button 316 may be depressed twice to activate the receiver for a predetermined series of intervals, during which time data from the appliance (transmitting for a fixed number of seconds immediately following reset) may be received.

An additional advantage to the above described time slotted transmission/reception implementation is that potential RF collisions between two or more appliances is avoided. This is due to the minimal transmission/-reception time period. Given another transmission from a second appliance on the same frequency and within the same reception range (with respect to the receiving unit), the probability that a collision will occur is only (30 msec.)/(1 min.) or 0.05%.

Referring once again to FIG. 3, an audible indicator 318 is included in the receiving unit 300 to alert the user of status information recently received. For example, the program control button 316 may be used to activate the audible indicator 318 (as an alert tone) shortly before or when an appliance cycle is complete, e.g. before the dryer finishes drying a load of clothes.

If the alert tone is not responded to, i.e., if the user fails to utilize the display control button 312 to display the status of the appliance, a visual (LCD) indicator 320 is provided as a memory function to the user that the new status information has been received and that the display control button 312 should be utilized to read this information.

It should be noted that the visual indicator 320 may be utilized to represent a number of different signals, each differentiated by the "on" time. For example, one signal may be represented by a constant "on", a second may be represented by a slowly flashing on/off, while yet a third may be represented by a quickly flashing on/off.

Conventional techniques, as are employed in electronic watches, may be utilized for programming the receiving unit functions using the control buttons 312, 314 and 316.

Figure 4A:
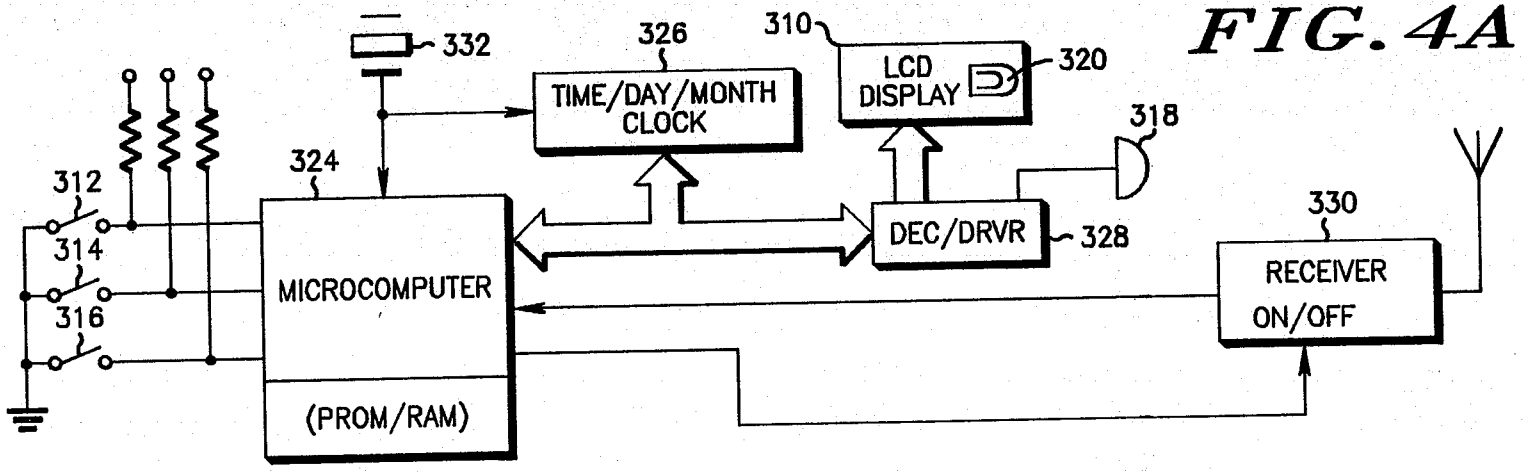
FIG. 4*a* is a block diagram of circuitry which may be used to implement the wristwatch/appliance status indicator shown in FIG. 3.

Referring now to FIG. 4*a*, a block diagram of circuitry which may be used to implement the receiving unit 300 is shown. The circuitry includes the LCD display 310, the audio indicator 318, the visual indicator 320 and the control buttons 312, 314 and 316 of FIG. 3. Additionally, a microcomputer 324 having internal ROM and RAM memory units is shown to control a conventional time/day/month clock 326, a decoder/-driver 328 and a receiver 330. A precision crystal oscillator 332 provides the time reference signals for the time/day/month clock 326 as well as for the internal clock of the microcomputer 324. Control of the receiving unit 300 of FIG. 3 is provided by the microcomputer 324 in response to the control buttons 312, 314 and 316 and in response to information received from the receiver 330.

Figure 4B:
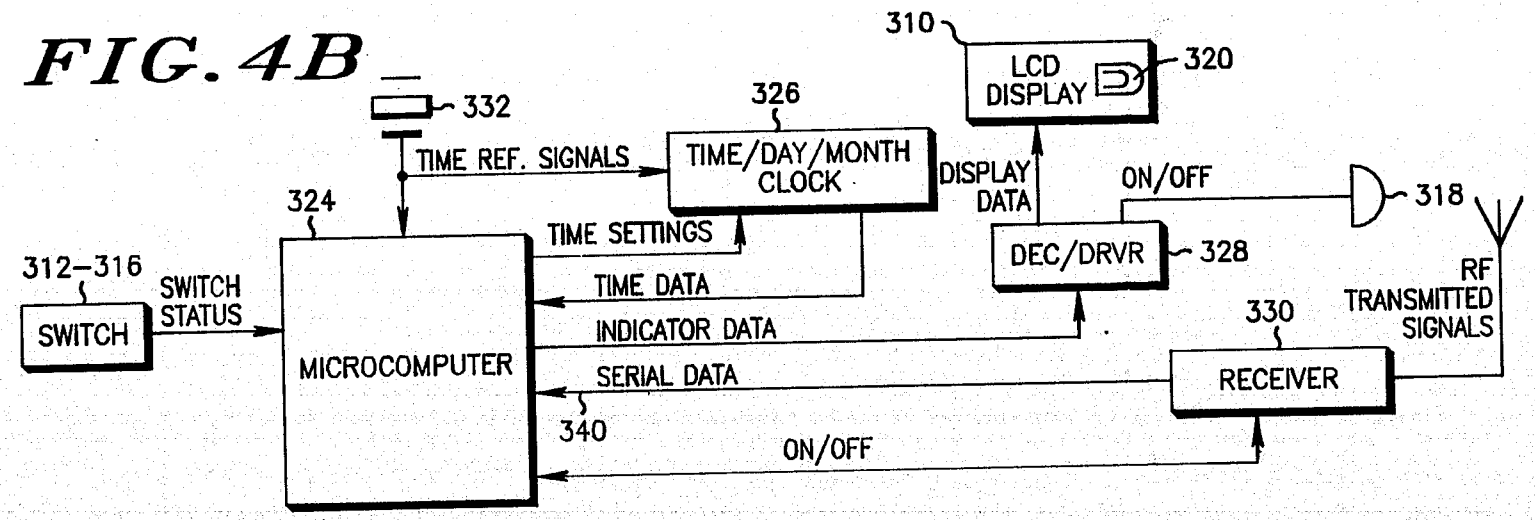
FIG. 4*b* is a flow diagram of showing the data flow between the various blocks of FIG. 4*a*.

In FIG. 4*b*, a flow diagram illustrates the type of data the microcomputer 324 uses and manipulates to effect such control. The data passed between the microcomputer 324 and the time/day/month clock 326 includes data for programming the time/day/month clock and data read from the time/day/month clock for later display at the LCD display 310. The data displayed at the LCD display 310 is passed along the microcomputer data bus as indicator data and decoded by the multiplexer driver 328. The decoder/driver 328 programs the LCD display 310 with the appropriate display information, as instructed by the microcomputer 324, and controls the on/off function of both the audible indicator 318 and the visual indicator 320. The microcomputer 324 controls the activation of the receiver 330, for the time slotted receive function as previously discussed, using an on/off control function to control battery power provided to the receiver 330. When the receiver is activated, the microcomputer monitors an internal serial input port 340 for analysis of data received over the air.

Actual implementation of this circuitry in a reasonably sized receiving unit as shown in FIG. 3 would of course require a custom VLSI design. However, specific architure for each of the blocks shown in FIG. 4*a* is known to those skilled in the art. For example, the Motorola MC146805 Microcomputer may be referenced for implementation of the microcomputer 324; Motorola's MC146818 Real Time Clock may be referenced for implementation of the time/day/month clock 326; and a wide variety of programmable logic arrays are available for implementation of the decoder/driver 328.

Figure 5A:
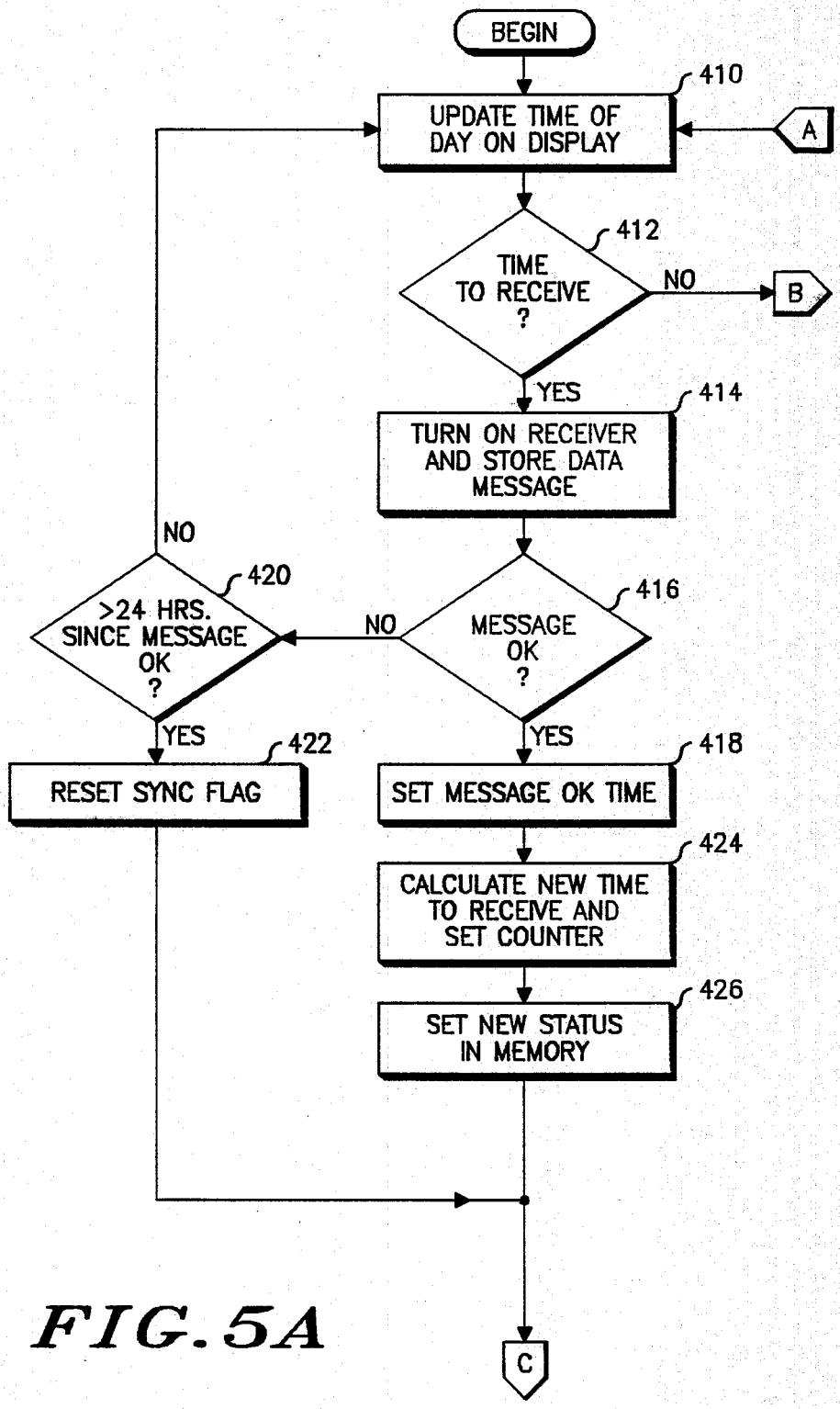
FIGS. 5A and 5B flowchart depicting a set of steps which may be employed to control the wristwatch/appliance status indicator of FIG. 3.
Figure 5B:
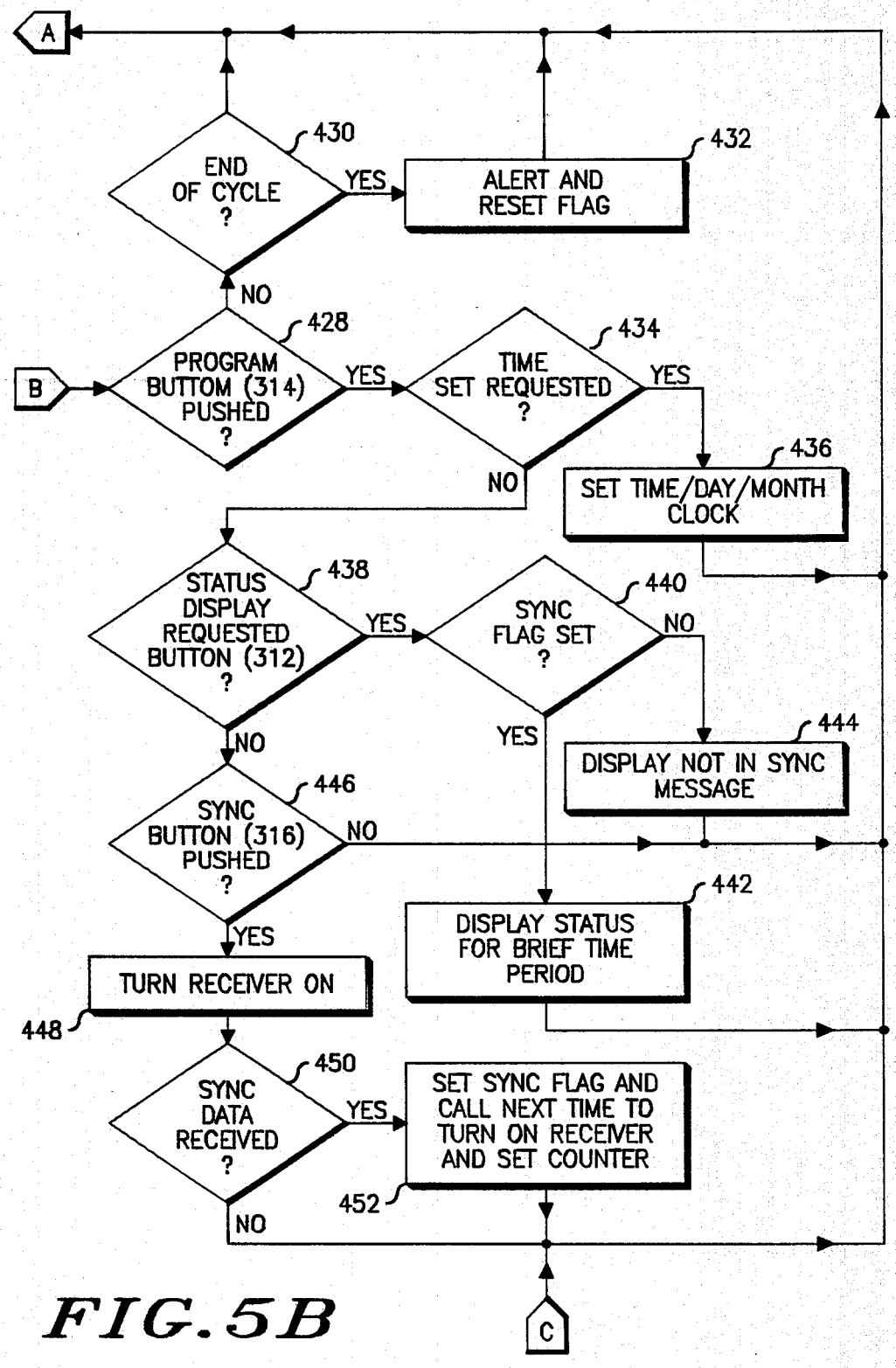

FIGS. 5A and 5B illustrates a set of steps, in flowchart form, which may be utilized by the microcomputer 324 for FIGS. 4*a* and 4*b* to implement control of the receiving unit 300 of FIG. 3. The flowchart begins at block 410 where the time is updated on the display. From block 410 flow proceeds to block 412 where a test is performed to determine whether or not it is time to turn on the receiver. If so, the receiver is turned on, and the message is received and stored in memory, depicted at block 414. At block 416 a test is performed to determine whether or not the message received contain intelligible data. Flow proceeds to block 418 if the message was intelligible and the time the message was received is recorded in memory. This recordation is performed so that if more than 24 hours have lapsed since the last intelligible message was received, depicted at block 420, a determination can be made that the receiving unit is no longer in synchronization with the appliance and a "sync" flag is reset, depicted at block 422, for subsequent resynchronization.

If the message received was intelligible, at block 424 the synchronization pattern from the received message is used to calculate the next time to turn on the receiver, and a corresponding counter provided therefor is set. At block 426 the received message is then utilized to update the status of the appliance in the memory. From block 426 flow returns to block 410.

Referring back to block 412, if it was not time to turn on the receiver, flow proceeds to block 428 where a test is performed to determine whether or not the program button (314) has been pushed. If not, flow proceeds to 430 where a test is performed to determine if the last status message received included an end of cycle indication. If not, flow returns to block 410. If an end of cycle was received, the audible indicator 318 is activated (and optionally the visual indicator 320) to alert the user that the appliance cycle is completed, depicted in block 432.

If the program button has been pushed (at block 428), flow proceeds to block 434 where a test is performed to determine if a request has been made to set the time/-day/month clock. If so, the clock is set at block 436 and flow returns to block 410. Otherwise, flow proceeds to block 438 where a test is performed to determine if a request to display the appliance status has been made. If so, flow proceeds to block 440 where the synchronization flag is examined to determine if the receiving unit is still in "sync" with the appliance. If synchronization is still intact, flow proceeds to block 442 where the appropriate appliance status is displayed for a brief period of time (about 4 seconds), depicted in block 442. Otherwise, block proceeds to block 444 where a message indicating that the receiving unit is no longer in sync is displayed for a brief time period.

If the outcome of the test performed by block 438 is negative, a test is performed at block 446 to determine if the appliance control button (316) has been pushed, indicating a request for resynchronization. If so, the receiver is turned on at block 448 in an attempt to receive transmitted data from the appliance, as previously described. From block 448, flow proceeds to block 450 where a test is performed to determine if the receiver has received synchronization data which would indicate resynchronization. If synchronization data has been recieved, flow proceeds to block 452 where the sync flag is set, a calculation is made to determine the next time to turn on the receiver, and the corresponding counter as set. Flow then returns to block 410 where this procedure is continually repeated.

While the invention has been particularly shown and described with reference to two preferred embodiments, it will be understood by those skilled in the art that various other modifications and changes may be made to the present invention described above without departing from the spirit and scope thereof.

What is claimed is:

1. An arrangement for remotely indicating the status of a laundry appliance, comprising:

detection means electrically connected to the appliance for detecting the status thereof and generating representative status signals;

signal conditioning means electrically connected to said detection means for receiving said status signals and encoding said signals for subsequent transmission therefrom;

transmission means electrically connected to said signal conditioning means for modulating and transmitting said encoded signals over the air; and receiver means for receiving and demodulating said transmitted signals over the air, said receiver means including decoder means for decoding said encoded signals, indicator means for indicating the status of the appliance, means for timing the operating time of the appliance and means for selectively controlling the indicator means from the decoded signals.

2. An arrangement for remotely indicating the status of an appliance, according to claim 1, wherein said detection means includes an AC current detector.

3. An arrangement for remotely indicating the status of an appliance, according to claim 1, wherein said detection means includes a vibrational detector.

4. An arrangement for remotely indicating the status of an appliance, according to claim 3, wherein said vibrational detector includes an electromechanical transducer for detecting vibrations emitted by the appliance.

5. An arrangement for remotely indicating the status of an appliance, according to claim 4, wherein said vibrational detector includes a variable amplifier for amplifying the signals received by the electromechanical transducer.

6. An arrangement for remotely indicating the status of an appliance, according to claim 4, wherein said vibrational detector includes a low pass filter for filtering interfering noises.

7. An arrangement for remotely indicating the status of an appliance, according to claim 1, wherein said means for indicating the status of the appliance includes an LCD display.

8. An arrangement for remotely indicating the status of an appliance, according to claim 1, wherein said transmission means includes means for transmitting the encoded signals serially in a frequency band between 30 MHz and 500 MHz.

9. An arrangement for remotely indicating the status of an appliance, according to claim 1, wherein said receiver means includes clock means for tracking the time of day.

10. A device, for use in proximity to a laundry appliance, for generating laundry appliance status signals for over the air transmission to a remote status indicator, comprising:

detection means for detecting the operating status of the laundry appliance;

encoding means for generating one or more output signals representative of said operating status wherein said encoding means includes means for determining a period during which the operation of the appliance has paused; and transmission means for transmitting said output signals over the air for brief time intervals when the operating status of the appliance changes.

11. A device for generating laundry appliance status signals, according to claim 10, wherein said detection means includes current sense means for detecting AC current being supplied to the appliance.

12. A device for generating appliance status signals, according to claim 11, further including plug and receptacle means, coupled to the detection means, for interfacing the AC current to the appliance.

13. A device for generating laundry appliance status signals, according to claim 10, wherein said detection means includes vibrational sense means coupled to the appliance for detecting the vibration of the appliance and for generating status signals representative thereof.

14. A device for generating laundry appliance status signals, according to claim 13, wherein said encoding means includes means for timing an initial period during which the appliance is vibrating to effect a delayed detection of the appliance status.

15. A device for generating laundry appliance status signals, according to claim 10, wherein said encoding means includes means for periodically activating said transmission means according to a preestablished timing schedule.

16. A device for receiving modulated appliance status signals transmitted over the air from a transmitting device for use in proximity to an appliance, comprising:

a receiver for receiving and demodulating the status signals;

a decoder for selectively converting said demodulated status signals to representative signals;

indicator means responsive to said demodulated status signals for indicating the status of the appliance; and timing means, coupled to said indicator means, for timing the operation of the appliance based on received status signals.

17. A device for receiving modulated appliance status signals, according to claim 16, wherein said timing means includes means for tracking the time of day.

18. An indicator device including an indicator display capable of remotely indicating the status of an appliance, comprising:

receiver means for receiving and demodulating transmitted radio frequency (RF) signals having encoded information associated with the status of the appliance therein, said receiver means including decoder means for decoding said encoded information;

oscillator means for generating a time based reference signal;

clock means, coupled to said oscillator means, for continually tracking time as a function of said time based reference signal; and controller means, coupled to said oscillator means and said receiver means, for selectively tracking appliance status information as referenced from the encoded information and the time based reference signal, for substantially synchronizing the receiver to the RF signals, and for displaying the status information and the time information on the indicator display.

19. A portable indicator device, according to claim 18, further including first power means for providing continuous power to the controller means and second power means, responsive to the controller means, for providing power to the receiver means.

20. A portable indicator device, according to claim 19, wherein said controller means further includes means to automatically activate power to the receiver means for brief time slots during which time slots transmitted information is received.

21. A portable indicator device, according to claim 20, wherein said controller means includes means to manually activate power to the receiver.

22. A portable indicator device, according to claim 19, wherein said controller means further includes means to automatically activate and deactivate power to the receiver means at periodic intervals.

23. An arrangement, having a sending device and an indicating device, for remotely indicating the status of an appliance, comprising:

the sending device having:

detection means electrically connected to the appliance for detecting the status thereof and generating representative status signals;

signal conditioning means electrically connected to said detection means for receiving said status signals and encoding said signals for subsequent transmission therefrom;

control means, electrically connected to said signal conditioning means, for initiating a transfer of program information therefrom to said indicator device, said program information including identification information;

transmission means electrically connected to said signal conditioning means for modulating and transmitting said encoded signals over the air to the indicator device; and the indicating device having:

receiver means for receiving and demodulating said transmitted signals and said program information from said sending device, decoder means for decoding said encoded signals, indicator means for indicating the status of appliance, and controller means for selectively controlling the indicator means as a function of the decoded signals.

24. An arrangement for remotely indicating the status of an appliance, according to claim 23, wherein said signal conditioning means includes means for encoding said signals with an identification code to identify the appliance.

25. An arrangement for remotely indicating the status of an appliance, according to claim 23, wherein said indicator means includes means for determining and recording an initial time remaining status of one or more cycles of the appliance.

26. An arrangement for remotely indicating the status of an appliance, according to claim 25, wherein said initial time remaining status is an estimated time determined, in part, as a function of an operator selected parameter.

27. An arrangement for remotely indicating the status of an appliance, according to claim 25, wherein said initial time remaining status is updated at intelligible status changes including manual interruption and "water fill" status changes.

28. An arrangement for remotely indicating the status of an appliance, according to claim 25, wherein said initial time remaining status is an estimated time determined, in part, as a function of one or more previous "water fill" times.

29. An arrangement for remotely indicating the status of an appliance, according to claim 23, wherein said controller means includes synchronization means for substantially synchronizing the receiver means to information represented through the status signals.

30. An arrangement for remotely indicating the status of an appliance, according to claim 29, wherein said controller means includes resynchronization means for substantially resynchronizing the receiver means to information represented through the status signals.

31. An arrangement for remotely indicating the status of an appliance, according to claim 29, where said controller means further includes means to automatically activate power to the receiver means for brief time slots during which time slots transmitted information is received.

32. An arrangement for remotely indicating the status of a laundry appliance, comprising:

detection means electrically connected to the appliance for detecting the status thereof and generating representative status signals;

signal conditioning means electrically connected to said detection means for receiving said status signals and encoding said signals into encoded signals for subsequent transmission therefrom;

transmission means electrically connected to said signal conditioning means for modulating and transmitting said encoded signals over the air; and receiver means for receiving and demodulating said transmitted signals over the air, said receiver means including decoder means for decoding said encoded signals, indicator means for indicating the status of the appliance and means for selectively controlling the indicator means from the decoded signals, said encoded signals including an initial time remaining status to inform the indicator means of an estimated time period during which the appliance will be operating.

33. An arrangement for remotely indicating the status of an appliance, according to claim 32, wherein said initial time remaining status is periodically updated by said transmission means.

34. A device, for use in proximity to a laundry appliance, for generating laundry appliance status signals for over the air transmission to a remote status indicator, comprising:

detection means for detecting the operating status of the laundry appliance;

encoding means for generating one or more output signals representative of said operating status wherein said encoding means includes means for periodically activating said transmission means according to a preestablished timing schedule; and transmission means for transmitting said output signals over the air for brief time intervals when the operating status of the appliance charges.

35. An indicator device including an indicator display capable of remotely indicating the status of an appliance, comprising:

receiver means for receiving and demodulating transmitted radio frequency (RF) signals having encoded information associated with the status of the appliance therein, said receiver means including decoder means for decoding said encoded information;

oscillator means for generating a time based reference signal;

clock means, coupled to said oscillator means, for continually tracking time as a function of said time based reference signal; and controller means, coupled to said oscillator means and said receiver means, for selectively tracking appliance status information as referenced from the encoded information and the time based reference signal, for substantially synchronizing and resynchronizing the receiver to the RF signals, and for displaying the status information and the time information on the indicator display.

* * * * *